United States Patent [19]

Owens

[11] Patent Number: 4,573,436

[45] Date of Patent: Mar. 4, 1986

[54] AIR COOLED HORIZONTAL POWER PISTON ENGINE

[76] Inventor: Charles A. Owens, P.O. Box 474, Warren, Tex. 77664

[21] Appl. No.: 554,211

[22] Filed: Nov. 22, 1983

[51] Int. Cl.[4] ..... F01P 9/00

[52] U.S. Cl. ..... 123/41.18; 123/41.67

[58] Field of Search ..... 123/41.18, 41.63, 41.65, 123/41.67, 41.68, 41.62, 41.01

[56] References Cited

U.S. PATENT DOCUMENTS

| | | | |
|---|---|---|---|
| 1,284,177 | 11/1948 | Camden | 123/41.18 |
| 1,660,706 | 2/1928 | Eversmann | 123/41.18 |
| 1,940,522 | 12/1933 | Ashmusen | 123/41.67 |
| 2,384,381 | 9/1945 | Jocelyn | 123/41.67 |
| 2,665,668 | 1/1954 | Ward | 123/41.67 |
| 3,086,506 | 4/1963 | Dobrosayljevic | 123/41.65 |
| 3,669,203 | 6/1972 | Honda | 123/41.67 |

OTHER PUBLICATIONS

Holman, "Heat Transfer", Fifth Edition, pp. 223–239.

*Primary Examiner*—William A. Cuchlinski, Jr.
*Attorney, Agent, or Firm*—Pravel, Gambrell, Hewitt & Kimball

[57] ABSTRACT

This invention relates to an air cooled horizontal power piston engine and to an improvement for conventional water cooled horizontal power piston engines by which such water cooled engines may be modified for cooling by ambient air. An efficient air cooling system for horizontal power piston engines, with structural features which in operative combination with such engine presents an engine of novel configuration, is described. The water jackets contained within the engine block and cylinder head of a conventional horizontal power piston engine are utilized as the chambers for passage of ambient air through the engine. The cylinder head is modified by providing it with passageways or opening which communicate the internal water jacket of the head to the atmosphere. The liquid cooling radiator unit is displaced by a high volume centrifugal fan blower which is operated by belt drive through the power transmission clutch connected to the engine crankshaft. In operation, the engine operates the blower which supplies a high volume of pressurized air to the water jacket of the cylinder housing of the engine block. The air provided by the blower circulates about the cylinder sleeve of the combustion chamber and passes to the water jacket of the cylinder head after which it is exhausted directly to the atmosphere through the opening provided in the head.

15 Claims, 5 Drawing Figures

AIR COOLED HORIZONTAL POWER PISTON ENGINE

FIELD OF THE INVENTION

This invention relates to an air cooled horizontal power piston engine and to an improvement for conventional water cooled horizontal power piston engines by which such water cooled engines may be modified for cooling by ambient air.

BACKGROUND OF THE INVENTION

Horizontal power piston engines are especially designed for oilwell pumping service and are the primary power source for operating oilfield pump equipment. Such engines are designed for slow speed operation in a wide variety of climates, ranging from hot arid to arctic environments. Conventional horizontal power piston engines are designed for continuous operation with minimum maintenance at a maximum rpm range of about 600 to 800 rpm.

Most conventional horizontal power piston engines are designed for liquid cooling by circulation of liquid coolant, such as water or water and antifreeze mixtures, within internal water jackets contained by the engine block and cylinder head. Thus, conventional liquid cooled horizontal power piston engines employ radiator units by which the temperature of the liquid coolant and, hence, the engine temperature, is regulated.

Although such engines are designed for minimum maintenance, the necessity of cooling such engines by liquid circulation through water jackets to a radiator unit introduces an inherent weakness to the engine design in terms of maintenance and potential down time of the engine. Namely, when a liquid cooling system is employed, proper operation of the engine can only be insured by proper operation of the liquid cooling system. Proper coolant composition suitable to the environment in which the engine is to be used must be provided, meaning an operator must monitor the cooling fluids periodically for proper antifreeze and corrosion inhibitor levels. Additionally, radiator units are prone to develop leaks and to develop corrosion on the cooling cores of the radiators which inhibit proper heat exchange operation. Further, makeup coolant must be added to the liquid cooling system periodically to maintain a proper coolant level and it is difficult to add makeup coolant to a horizontal power piston engine while the engine is in operation.

Heretofore various designs and means for air cooling of internal combustion engines have been employed or suggested. Some air cooling designs are functionally related to the intended use of the engine—such as an airplane engine or motorcycle engine—and employ air cooling design features, such as a plurality of heat exchanging fins secured to the cylinder wall across which air passes while the engine is in motion, which features would not be effective for air cooling of a stationary engine. Various designs have been proposed for air cooling internal combustion engines which employ relatively unrestricted passages or chambers about the cylinders specifically designed for the passage of air, as opposed to liquid circulation. Hence, Marsh, U.S. Pat. No. 1,330,207 and Till, U.S. Pat. No. 2,315,462 employ hoods of specific design which jacket the engine cylinders to create relatively unobstructed passageways adjacent to the cylinder walls through which air is drawn by a vacuum producing means operated by the engine exhaust system.

Others have suggested air cooling means which utilize the water jackets of an engine designed for liquid cooling as the passages through which air is drawn for air cooling. Sauer, U.S. Pat. No. 2,188,444 employs an air scoop to collect and direct air into the water jackets of an automobile engine and connects the outlet side of the water jacket to a turbine, operated by the engine exhaust gases, to draw a vacuum on the water jacket. The combined action of supplying air to the jacket under the elevated pressure via the air scoop in conjunction with drawing a vacuum on the outlet side of the water jacket by turbine action is said to permit a sufficient circulation of ambient air within the engine water jacket to achieve proper cooling. In an earlier proposal, by Brittain, U.S. Pat. No. 1,800,927, the same kind of push-pull system was suggested for an automobile engine, but Brittain used an air blower to supply pressurized air to the inlet of the water jacket. Again, in the Brittain proposal provisions for supplying pressurized inlet air and evacuating outlet air had to be employed in order to secure adequate air circulation within the water jacket of the engine for proper cooling.

None of the above proposals are suitable for application to a horizontal power piston engine of conventional design. Most horizontal power piston engines are of a single cylinder design and operate from a stationary position. Since such engines operate on a single cylinder, the engine exhaust gases cannot be utilized to operate a vacuum device for drawing air from about the water jacket because this would disrupt the proper flow of exhaust gases from the combustion chamber and adversely effect engine operation. Likewise, since the engine operates in a stationary piston, it has no forward momentum through the atmosphere by which air may be scooped into the engine or caused to pass through the water jacket about the cylinder wall of the engine. Heretofore, no design has been proposed for a horizontal power piston engine by which such engine could be air cooled.

A need exists for a horizontal power piston engine design which eliminates the problems inherent with cooling such engines by liquid cooling systems. A horizontal power piston engine of a design suitable for cooling by ambient air is highly desirable, especially in arctic climates where liquid coolant systems are prone to freeze up and in acid climates where such systems are prone to boil over. Likewise, it would be desirble to have a means by which conventional horizontal power piston engines designed for liquid cooling could be modified to cooling by ambient air.

SUMMARY OF THE INVENTION

A means for modifying conventional horizontal power piston engines for cooling by ambient air is disclosed. An efficient air cooling system for horizontal power piston engines, with structural features which in operative combustion with such engine presents an engine of novel configuration, is described. The water jackets contained within the engine block and cylinder head of a conventional horizontal power piston engine are utilized as the chambers for passage of ambient air through the engine. The cylinder head is modified by providing it with passageways or opening which communicate the internal water jacket of the heat to the atmosphere. The liquid cooling radiator unit is displaced by a high volume centrifugal fan blower which is operated by belt drive through the power transmission clutch connected to the engine crankshaft. In operation, the engine operates the blower which supplies a high volume of pressurized air to the water jacket of the cylinder housing of the engine block. The air provided by the blower circulates about the cylinder sleeve of the combustion chamber in heat exchange relationship and passes to the water jacket of the cylinder head for further heat exchange after which it is exhausted directly to the atmosphere through the opening provided in the head which communicate the water jacket of the cylinder head to the atmosphere.

DESCRIPTION OF THE INVENTION

Figure 1:
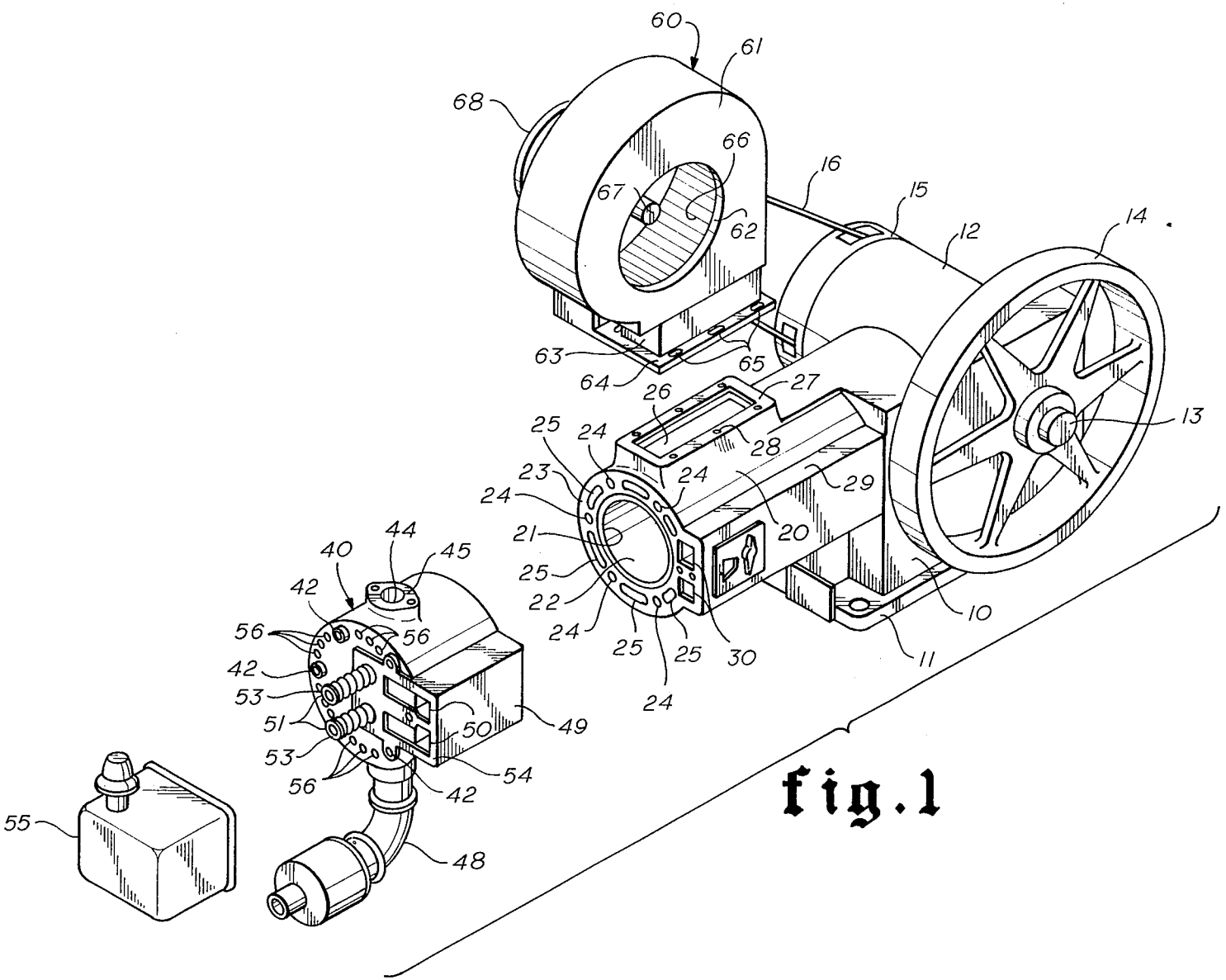
FIG. 1 is an isometric exploded view the main elements of a horizontal power piston engine adapted to air cooling in accordance with the invention. The engine block and valve cover illustrated are of conventional construction; the cylinder head is of conventional construction except as otherwise noted in the description; and a centrifugal fan blower is shown in place of a radiator unit which otherwise would be present in a conventional engine. Otherwise conventional parts of the horizontal power piston engine such as the piston, pushrods, rocker arms, carburetor and the like are not illustrated.

FIG. 1 illustrates, in isometric exploded perspective, those parts of a horizontal power piston internal combustion engine which are of importance to an understanding the air cooled engine of of this invention. Parts not illustrated in FIG. 1—such as pistons, pushrods, rocker arms, valves, carburetors, crankshafts, magneto, etc.—are all conventional engine parts of conventional construction and it is understood that such parts are present in operative embodiments of the air cooled engine of this invention.

With reference to FIG. 1, the engine block 10 is of any of the designs conventional to a liquid cooled horizontal power piston engine. The engine block 10 is an integrally formed unit comprising an engine block base 11, cylinder housing 20 and crankshaft housing 12. A crankshaft is appropriately journaled within the crankshaft housing and is operatively connected to the power piston and cam shaft thereof. Flywheel 14 is connected to an exposed end 13 of the crankshaft which is journaled in crankshaft housing 12. The other end of the crankshaft is provided with a clutch assembly of standard design (not illustrated) contained within clutch housing 15 by which rotational motion of the crankshaft may be transmitted by a belt or drive means 16 to operate a centrifugal fan blower 60.

Engine block 10 is cast to produce a cylinder housing 20 formed with internal chambers which, in conjunction with cylinder sleeve 21, define the passageway or "water jacket" within the cylinder housing which is intended to receive a cooling liquid for circulation about the external side of sleeve 21 to absorb and remove heat from combustion chamber 22 of the engine. In a conventional liquid cooled horizontal power piston engine, the water jacket of cylinder housing 20 is communicated with a radiator unit through opening 26 formed in cylinder housing 20 and with internal water jackets carried by cylinder head 40 through openings 25 at the end surface 23 of cylinder housing 20 to which cylinder head 40 is mated. End surface 23 also contains threaded sockets 24 which receive bolts (not illustrated) which pass through openings 42 in head 40 and secure head 40 to cylinder housing 20 through an appropriate gasket means (not illustrated).

Figure 2:
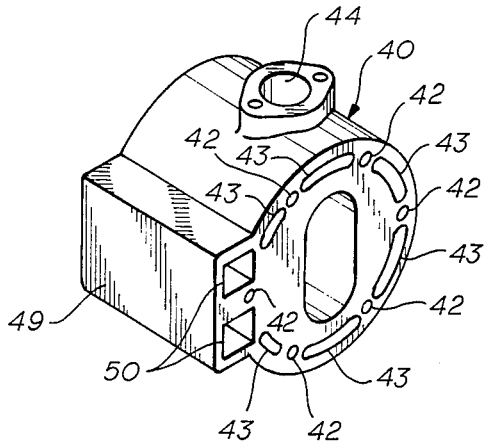
FIG. 2 is a perspective view of the cylinder head illustrated in FIG. 1, but the FIG. 2 view is rotated 180° about its vertical axis to illustrate that surface of the cylinder head which mates to a receiving surface of the engine block cylinder housing.

Cylinder head 40 is also conventionally formed to contain an internal passageway or "water jacket" for circulation of cooling liquid. When cylinder head 40 is mated to cylinder housing 20 through end surface 41, the water jacket of cylinder head 40 communicates with the water jacket of said cylinder housing 20 through openings 43 (seen in FIG. 2) which register with openings 25 of the end surface 23 of the cylinder housing 20. Cylinder head 40, as illustrated, is also conventionally formed to contain a fuel inlet port 44, carburetor mating surface 45, exhaust gas outlet port, muffler mating surface 47, valve passage ways 52, valve cover receiving surface 54, push rod chamber 49 and push rod passage way 50. As illustrated in FIG. 1, a muffler 48 is in place on head 40 and the head is illustrated with valves 51 and valve springs 52 in place.

Conventional horizontal power piston engines are liquid cooled (either with water or a mixture of water and antifreeze) and, hence, are provided with a radiator unit (cooling core, water hopper and cooling fan—not illustrated) which is mounted in liquid tight engagement to mating surface 27 which surrounds the perimeter of opening 26 in cylinder housing 20. With a radiator unit securely in place, a circulation loop closed to the atmosphere is defined within which a liquid is received and circulated between the water jacketing of housing 20, head 40 and the radiator unit for liquid cooling of the engine. Depending upon the climate and environment within which the engine is intended for use, the liquid cooling system of a conventional engine may be operated as a vapor system form, a pressurized-condensing system form or a thermo-syphon form. In the vapor system form, cooling liquid in the water jackets take up heat from the engine and rise as vapor into the radiator cooling core where by indirect heat exchange it is cooled and condensed by the cooling action of a radiator fan. A small exhaust opening is provided in the front center tube of the radiator unit by which any air within the radiator may first be exhausted to ensure proper vaporization within the radiator during engine operation. The cooled condensed water falls from the radiator cooling core back into a water hopper from which it is returned to the water jacket of the cylinder housing for re-circulation about the closed cooling loop. The pressurized-condensing system form of operation is similar except, since this form of system is designed for high atmospheric operation, it is a completely closed system which operates at a pressure of about 4 pounds above atmospheric. In the thermo-syphon form the cooling loop is completely filled with coolant and circulation is produced by thermo convection currents.

Problems inherent with liquid cooling systems—i.e., maintaining a proper coolant mix of water-antifreeze, radiator corrosion, radiator leaks, maintenance of proper cooling level and the like—are avoided in the present invention by converting the conventional liquid cooled engine to a configuration wherein it may be cooled by passing ambient air through the water jackets thereof and exhausting said air directly to the atmosphere through appropriate openings 56 provided in head 40. In accordance with the invention, the radiator unit is removed and replaced with a high volume centrifugal fan air blower 60. Blower 60 is mounted to the cylinder housing 20 of the engine by mounting the air discharge end 63 of blower 60 in air tight sealing engagement to mating surface 27 of cylinder housing 20. The power transmission means, such as belt drive 16, previously used to power the cooling fan of a radiator unit, is instead connected in operative engagement to the drive sheave 68 of blower 60. The air discharge end 63 of blower 60 is provided with a mouting skirt having a mounting flange 64 which contains oblong openings 65 positioned to register with the threaded retaining sockets 28 carried by mating surface 27 of the cylinder housing 20. Blower 60 is secured to the mating surface 27 of cylinder housing 20 by securing bolts (not illustrated) which pass through mounting flange openings 65 and are received into and securely engaged in threaded retaining sockets 28. The oblong opening 65 carried by mounting flange 64 of blower 60 permit blower 60 to be so positioned about mating surface 27 of cylinder housing 20 such that any desired amount of tension may be placed on the drive belt 16 which transmits power from the engine clutch assembly to the drive sheave 68 of blower 60.

Figure 3:
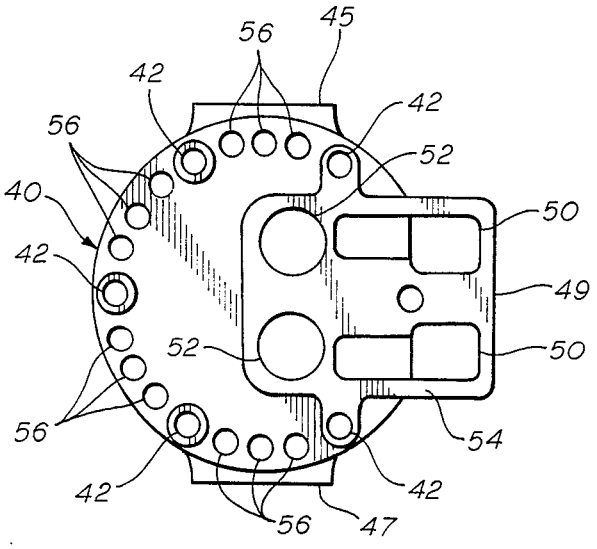
FIG. 3 is a plan view of the top of the cylinder head illustrated by FIG. 1.

To accommodate the engine to ambient air cooling, cylinder head 40 is provided with a plurality of openings 56 which communicates the water jacket within head 40 to the external atmosphere. As best illustrated in FIG. 3, openings 56 are placed about the periphery of head 40 at locations which will not be obstructed when valve cover 55 is secured to the valve cover receiving surface 54 carried by head 40. Alternatively, cylinder head 40, when formed by casting or other fabricating techniques, may be formed to have openings 56 which communicate the water jackets of the head to the atmosphere.

Since the horizontal power piston engine is intended only for stationary operation, such as at an oilwell site where it provides the motive force to operate an oilwell pump, there is no external phenomenon which can be relied upon to assist air cooling. The blower 60 selected and the design and number of air exhaust openings 56, provided in cylinder head 40, must be properly selected to ensure proper cooling and engine operation. The horizontal power piston engine is by design a low rpm engine. Since the blower is operated by power takeoff from the engine clutch assembly connected to the crankshaft, a high air volume at low rpm air blower must be employed. To ensure the engine operates at the most appropriate cylinder temperature from the standpoint of maintenance and economy, the number and sizing of the air exhaust openings 56 must be appropriately selected with reference to the horsepower output of a particular model of engine. In part, the blower size and the number and sizing of air exhaust openings 56 are related to the design rpm and horsepower output of the engine.

Blowers of the centrifugal fan type, such as a single inlet volume-pressure blower of the kind manufactured by Dayton Electric Manufacturing Company, are suitable for use in the air cooled engines of this invention. Such blowers provide a high volume of air at medium to high pressures. The blower 60 comprises a balanced multi-vane impeller 66, mounted within a fan casing or impeller housing 61, for direct drive from an external power source through drive sheave 68 to which the impeller is connected by driveshaft 67. Power is supplied from the engine clutch assembly to blower drive sheave 68 by belt drive means 16.

The cubic feet per minute of air delivery of which a particular centrifugal fan type blower 60 is capable is dependent upon the rpm at which the blower operates and the static pressure against which the blower must operate to move ambient air through the water jacket of the engine cooling system. The rpm at which blower 60 operates is governed by the drive ratio of blower drive sheave 68 to the clutch gear to which blower drive sheave 68 is coupled by drive belt 16. Since the engines to which this invention is applicable are designed for operation between about 200 rpm to about a maximum of 800 rpm, a drive ratio of from about 2:1 to about 3:1 will permit a blower rpm from about 600 to about 2400.

Figure 5:
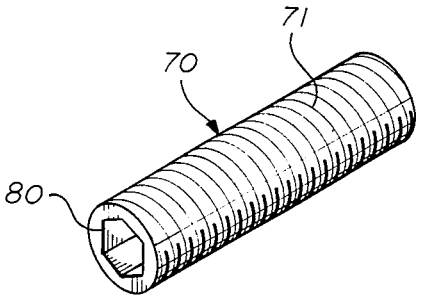
FIG. 5 is a perspective view of an orifice insert which may be installed in one or more of the air exhaust openings of the cylinder head to vary the total of the cross section area of the air exhaust opening thereof.

The effective static pressure against which blower 60 operates is determined by the total cross sectional area of air outlet openings 56 which are prepared in cylinder head 40. Preferably, the interior surface of openings 56 are provided with engaging thread by which variable orifice inserts 70, as illustrated by FIG. 5, may be secured within openings 56. Openings 56 themselves function as exhaust ports through which air supplied to the water jacket of cylinder head 40 by blower 60 is exhausted directly to the atmosphere. Since the blower 60 is driven by a belt drive 16 through the power transmission clutch of the engine, the rpm at which the blower 60 operates is directly related by the drive ratio to the rpm at which the engine is operated. The amount of ambient air which is passed through the water jacket of the cylinder housing 20 and cylinder head 40 for cooling depends upon the particular rpm at which the engine operates at a given time and upon the sum of the cross sectional area of openings 56 provided in head 40. As the sum of the cross sectional area of openings 56 decreases, the static pressure against which blower 60 must operate, and consequently the about of ambient air which it is capable of passing through the engine at a given rpm of operation decreases.

Inserts 70 may be screwed into one or more of the openings 56 of head 40 to decrease the effective total cross section area of openings 56 to decrease the amount of cooling air throughput for the air cooled engine. Preferably, such inserts may be employed in frigid climates to, in effect, thermostat the air cooled engine to a desirable temperature range for operation.

Inserts 70 comprise an exteriorly threaded stud 71 formed with a longitudinally located passageway 72 therethrough. The longitudinally located passageway 72 is preferably of a hexagonal cross sectional shape. The hexagonal shape of the longitudinal passageway 72 permits the insert to be conveniently inserted or removed from a threaded opening 56 by a hexagonal stud driving tool.

To adapt low horsepower output engines, that is, those designed for a horsepower output of about 11 at a maximum rpm of 800, the cylinder head 40 should be provided with a sufficient number of openings 56 to the water jacket thereof such that the sum of the cross sectional area of the openings 56 in the cylinder head preferably totals to about 1.80 square inch. For medium horse power output engines, that is, those designed to deliver about 15 horse power at maximum rpm, the sum of the cross sectional area of the opening provided in the cylinder head should preferably total about 2.36 square inches. For high horsepower output engines, that is, those whose deliver from about 20 to about 35 horsepower at maximum rpm, the sum of the cross sectional area of the opening provided in the cylinder head should preferably total about 7.22 square inches. Within the above described ranges, sufficient amounts of ambient air can be cause to flow through the watering jacketing of a horizontal power cylinder engine by a high volume air blower to ensure adequate cooling of the engine with ambient air ranging in temperature from about 0° F. to about 140° F. For ambient air temperatures of less than about 0° F., orifice inserts 70 may be installed in one or more of the openings 56 of head 40 to reduce air flow through the engine and thus achieve a proper operating temperature for the engine. The number of individual openings 56 employed, and their pattern of placement about the cylinder head is generally not critical, provided only that the patterning of openings 56 is such as to permit air to circulate equally about all part of the cylinder sleeve and the cylinder head. Preferably, the openings are positioned in a symmetrical pattern in the cylinder head with an approximately equal spacing. The pattern as illustrated in FIG. 3, of twelve openings placed about the periphery of the cylinder head in areas unobstructed by the valve cover has been found to be suitable. For a twelve hole pattern as illustrated by FIG. 3, the diameter for each opening for a low horsepower engine may be 0.4375 inch; for a medium horsepower engine, the diameter for each opening may be 0.5 inch; and for a high horsepower engine, the diameter for each opening should be 0.875 inch.

Figure 4:
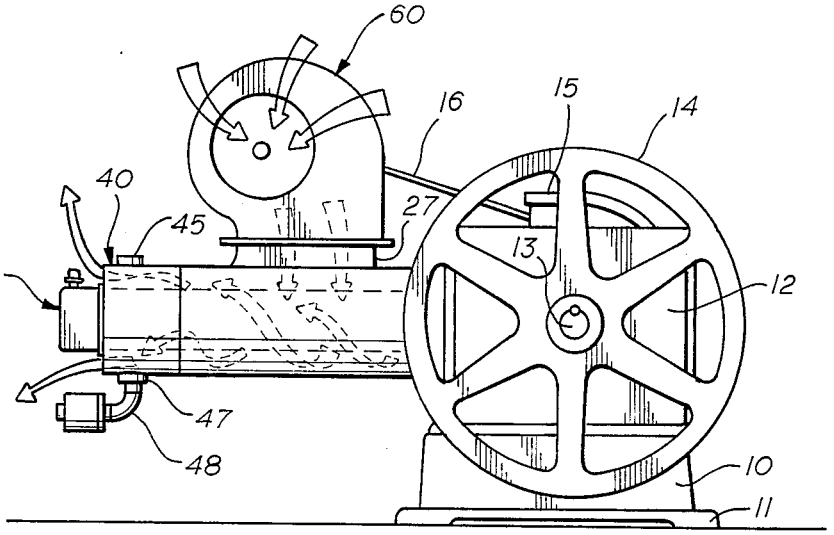
FIG. 4 is a drawing of the air cooled engine in plan view with arrows representing the pathway of forced air cooling about the piston sleeve, illustrated by dashed lines, and the exhaust of said cooling air to the atmosphere through the air exhaust ports or openings provided in the cylinder head.

To ensure proper cooling across all ranges of climate and conditions over which the horizontal power piston engine may normally be operated, the air cooling system should be designed to pass from about 500 cfm to about 1800 cfm of ambient air through the water jacketing of the engine. Within this range of ambient air passage across cylinder sleeve 21 and through cylinder head 40, the engine will operate at a cylinder temperature of less than 212° F. when operated in climates ranging from 0° to 130° F. ambient temperature. FIG. 4 schematically illustrates the passage of ambient air through the engine by blower 60, against and around the cylinder sleeve 21 to the cylinder head 40 from which it is then exhausted to the atmosphere through openings 56.

An Arrow Single Cylinder Engine, Model C-66 (manufactured by Arrow Specialty Co.) was modified for air cooling in accordance with the invention. The liquid radiator unit of the engine was removed and a Dayton Single Inlet Volume-Pressure Blower, Model 4C119 was installed in its place. The blower discharge end was mounted in air tight engagement to the radiator opening of the cylinder housing. The blower sheave gear was connected to the engine clutch assembly through a drive belt and the blower was operated at a drive ratio of 2.54. The cylinder head was drilled to provide a series of opening which communicated the cylinder head water jacket to the atmosphere, twelve such openings were made, in the pattern as shown by FIG. 3, with each opening being of ½" diameter.

The air cooled engine as described above was operated at various rpm setting and the temperature of the outlet air from the cylinder head was measured, with the following results. The ambient air temperature during engine operation was about 75° F.

AIR COOLED ARROW SINGLE CYLINDER C66 ENGINE

| ENGINE | | OUTLET AIR | AIR | |
|---|---|---|---|---|
| RPM | HORSE POWER | TEMPERATURE F.° | FLOW SCFM | BLOWER RPM |
| 200 | | 140° F. | 560 | 509 |
| 300 | | 155° F. | 920 | 763 |
| 400 | 5 | 170° F. | 1160 | 1018 |
| 500 | 11 | 180° F. | 1290 | 1272 |
| 600 | 12 | 187° F. | 1460 | 1527 |
| 700 | 15 | 190° F. | 1610 | 1781 |

The foregoing disclosure and description of the invention are illustrative and explanatory thereof, and various changes in the size, shape and materials, as well as in the details of the illustrated construction may be made without departing from the spirit of the invention.

I claim:

1. In a stationary horizontal power piston internal combustion engine having a design power output at maximum rpm of from about 11 to about 35 horsepower and having a cylinder head and engine block formed with internal water jackets designed to communicate through a radiator attached to said engine block to form a circulation loop closed to the atmosphere into which a liquid is received and circulated for liquid cooling of said engine, an improvement which adapts said engine to cooling by ambient air flow comprising:

a high volume air blower, said air blower taking in atmospheric air having a temperature as high as about 140° F., the air discharge end of which is mounted in close proximity to and in airtight sealing engagement to that mating surface on said engine block designed to receive a radiator unit for communication with the internal water jacket of said engine block, thereby minimizing resistance to air flow therebetween;

means for transmitting rotational motion of the crankshaft of said engine to said blower to operate said blower while said engine is in operation; and a cylinder head provided with openings therein which communicate the internal water jacket of said cylinder head directly to the external atmosphere by which ambient air supplied by said blower to the internal water jacket of said engine block for circulation to the internal water jacket of said cylinder head is exhausted directely to the atmosphere through said openings after traversing once through the water jacket of said engine block and cylinder head.

2. The improvement of claim 1, wherein the sum of the cross sectional area of the openings provided in said cylinder head is from about 1.80 to about 7.22 square inches.

3. The improvement of claim 1, wherein said blower is a centrifugal fan blower.

4. The improvement of claim 3, wherein said blower supplies ambient air to said water jackets at a rate of from about 500 to about 1800 SCFM.

5. The improvement of claim 1, wherein the openings which communicate the internal water jacket of said cylinder head directly to the atmosphere are formed with threads on the interior surface of such openings.

6. The improvement of claim 1, wherein said means for transmitting rotation motional to said blower comprises an endless belt.

7. The improvement of claim 1 wherein:

said openings in said cylinder head are disposed adjacent the periphery of an end surface thereby allowing the air to evenly distribute within said cylinder head before being exhausted to the atmosphere.

8. An air cooled stationary horizontal power piston engine, having a design power output at maximum rpm from about 11 to about 35 horsepower, comprising:

an engine block having a cylinder housing containing an internal water jacket and a mating surface thereon for receiving and communicating a radiator to the water jacket thereof;

a cylinder head mated to said cylinder housing, said cylinder head containing an internal water jacket which communicates with the water jacket of said cylinder housing, and said cylinder head having openings therein which communicate the water jacket of said cylinder head directly to the atmosphere;

a high volume air blower, said blower taking in atmospheric air having a temperature of as high about 140° F., mounted at its air discharge end in close proximity to and in airtight sealing engagement to that mating surface on said cylinder housing designed to receive a radiator, thereby minimizing resistance to air flow therebetween; and means for transmitting rotational motion of the crankshaft of said engine to said blower to operate said blower when said engine is in operation.

9. The engine of claim 8, wherein the sum of the cross sectional area of the openings provided in said cylinder head is from about 1.80 to about 7.22 square inches.

10. The engine of claim 8, wherein said blower is a centrifugal fan blower.

11. The engine of claim 10, wherein said blower supplies ambient air to said water jackets at a rate of from about 500 to about 1800 SCFM.

12. The engine of claim 8, wherein the openings which communicate the internal water jacket of said cylinder head directly to the atmosphere are formed with threads on the interior surface of such openings.

13. The engine of claim 8 wherein:

said openings in said cylinder head are disposed adjacent the periphery of an end surface thereby allowing the air to evenly distribute within said cylinder head before being exhausted to the atmosphere.

14. In a horizontal power piston internal combustion engine having a cylinder head and engine block formed with internal water jackets designed to communicate through a radiator attached to said engine block to form a circulation loop closed to the atmosphere into which a liquid is received and circulated for liquid cooling of said engine, an improvement which adapts said engine to cooling by ambient air flow comprising:

a high volume air blower, the air discharge end of which is mounted in air tight sealing engagement to that mating surface on said engine block designed to receive a radiator unit for communication with the internal water jacket of said engine block;

means for transmitting rotational motion of crank shaft of said engine to said blower to operate said blower while said engine is in operation;

a cylinder head provided with openings therein which communicate the internal water jacket of said cylinder head directly to the external atmosphere by which ambient air supplied by said blower to the internal water jackets of said engine block for circulation to the internal water jacket of said cylinder head is exhausted directly to the atmosphere through said openings after traversing once through the water jacket of said engine block and cylinder head;

wherein the openings which communicate the internal water jacket of said cylinder head directly to the atmosphere are formed with threads on the interior surface of such openings; and wherein an exteriorly threaded stud having an longitudinally extending passageway therein is installed in at least one of said threaded openings of said cylinder head.

15. An air cooled horizontal power piston engine comprising:

an engine block having a cylinder housing containing an internal water jacket and a mating surface thereon for receiving and communicating a radiator to the water jacket thereof;

a cylinder head mated to said cylinder housing, said cylinder head containing an internal water jacket which communicates with the water jacket of said cylinder housing, and cylinder head having openings therein which communicate the water jacket of said cylinder head directly to the atmosphere;

a high volume air blower mounted at its air discharge end in air tight sealing engagement to that mating surface on said cylinder housing designed to receive a radiator;

means for transmitting rotational motion of the crankshaft of said engine to said blower to operate said blower when said engine is in operation;

wherein the openings which communicate the internal water jacket of said cylinder head directly to the atmosphere are formed with threads on the interior surface of such openings; and wherein an exteriorly threaded stud having a longitudinally extending passageway therein is installed in at least one of said threaded openings of said cylinder head.

* * * * *

UNITED STATES PATENT AND TRADEMARK OFFICE

CERTIFICATE OF CORRECTION

PATENT NO. : 4,573,436

DATED : March 4, 1986

INVENTOR(S) : Charles A. Owens

It is certified that error appears in the above-identified patent and that said Letters Patent is hereby corrected as shown below:

Column 2, line 36, delete "piston" and insert --position--

Column 2, line 49, delete "acid" and insert --arid--

Column 2, line 67, delete "heat" and insert --head--

Column 6, line 34, delete "thread" and insert --threads--

Column 7, line 13, delete "whose" and insert --which--

Column 8, line 57, delete "jacket" and insert --jackets--

Signed and Sealed this

*Second* Day of *September 1986*

[SEAL]

*Attest:*

DONALD J. QUIGG

*Attesting Officer*

*Commissioner of Patents and Trademarks*